US012129593B1

(12) United States Patent
Chen

(10) Patent No.: US 12,129,593 B1
(45) Date of Patent: Oct. 29, 2024

(54) HOLDER FOR CAP WASHING

(71) Applicant: Kingstar Technology LLC, Rowland Heights, CA (US)

(72) Inventor: Zhi Chen, Guangdong (CN)

(73) Assignee: Kingstar Technology LLC

( * ) Notice: Subject to any disclaimer, the term of this patent is extended or adjusted under 35 U.S.C. 154(b) by 0 days.

(21) Appl. No.: 18/618,174

(22) Filed: Mar. 27, 2024

(30) Foreign Application Priority Data

Dec. 29, 2023 (CN) ..... 202323665154.6

(51) Int. Cl.
*A45C 11/02* (2006.01)
*D06F 95/00* (2006.01)

(52) U.S. Cl.
CPC ..... *D06F 95/008* (2013.01); *A45C 11/02* (2013.01)

(58) Field of Classification Search
CPC ..... D06F 95/008; A45C 11/02; A42B 1/002; A42B 1/00
USPC ..... 206/9
See application file for complete search history.

(56) References Cited

U.S. PATENT DOCUMENTS 5,172,837 A * 12/1992 Finney, Jr. ..... A42B 1/002 223/66

* cited by examiner

*Primary Examiner* — Don M Anderson
*Assistant Examiner* — Jessica Kavini Tamil
(74) *Attorney, Agent, or Firm* — ScienBiziP, P.C.

(57) ABSTRACT

A holder for cap washing, comprising an upper frame and a lower frame detachably connected to each other, wherein the upper frame comprises an upper fixed frame and an upper deformable frame detachably connected to each other, the lower frame comprises a lower fixed frame and a lower deformable frame detachably connected to each other, the upper fixed frame is detachably mounted to the lower fixed frame, and a space for accommodating a brim of the cap is formed between the upper fixed frame and the lower fixed frame, the upper deformable frame is detachably mounted to the lower deformable frame, and a space for accommodating a crown of the cap is formed between the upper deformable frame and the lower deformable frame.

10 Claims, 4 Drawing Sheets

100

HOLDER FOR CAP WASHING

CROSS-REFERENCES TO RELATED APPLICATIONS

This application claims the benefit of priority to Chinese Patent Application Number 202323665154.6, filed on Dec. 29, 2023, in the China National Intellectual Property Administration. The entire contents of the above-identified application are hereby incorporated by reference.

FIELD OF THE INVENTION

The present disclosure relates to a holder for cap washing.

BACKGROUND

Since the woven fabric of compositions of the cap easily accumulates sweat, dust, etc. due to long-term wearing, the cap is need for cleaning. However, directly putting into the washing machine easily results in deformation of the cap during washing, and the existing laundry bag can only prevent different washings from twisting with each other, the deformation of the cap during washing cannot be avoided, hand-washing is still required at present, and the problem of insufficient washing and the trouble of hand-washing still exists. It would be desirable to have a holder for cap washing capable of supporting the cap to avoid deformation thereof.

Meanwhile, miniaturization of such a holder for cap washing is desired for convenience of transportation.

SUMMARY OF THE DISCLOSURE

The present disclosure is proposed to solve the above problems existing in the prior art.

A holder for cap washing, comprising: an upper frame comprising an upper fixed frame and an upper deformable frame detachably connected to the upper fixed frame; and a lower frame detachably connected to the upper frame and comprising a lower fixed frame and a lower deformable frame detachably connected to the lower fixed frame, wherein the upper fixed frame is detachably mounted to the lower fixed frame, and a first space for accommodating a brim of the cap is formed between the upper fixed frame and the lower fixed frame, the upper deformable frame is detachably mounted to the lower deformable frame, and a second space for accommodating a crown of the cap is formed between the upper deformable frame and the lower deformable frame.

Furthermore, the upper deformable frame comprises: an upper deformable member having elasticity, and capable of being bent and deformed according to the shape of the crown, and detachably connected to the upper fixed frame, an upper connecting member detachably connected to the upper deformable member, the lower deformable frame comprises: a lower deformable member having elasticity, and capable of being bent and deformed according to the shape of the crown, and detachably connected to the lower fixed frame, and a lower connecting member detachably connected to the lower deformable member.

Furthermore, the upper deformable member comprises a plurality of upper deformable parts, one end of each of the plurality of upper deformable parts is connected to each other, and the other end of each of the plurality of upper deformable parts is detachably connected to the upper connecting member and the upper fixed frame, and the lower deformable member comprises a plurality of lower deformable parts, one end of each of the plurality of lower deformable parts is connected to each other, and the other end of each of the plurality of lower deformable parts is detachably connected to the lower connecting member and the lower fixed frame.

Furthermore, the upper deformable part comprises a first mounting portion disposed on one end of the upper deformable part and a first mounting foot disposed on at an end of the upper deformable part away from the first mounting portion, at least one first bending portion is extended from the first mounting portion to a direction away from the first mounting portion, a plurality of the upper deformable parts are connected by their respective first mounting portions, and the first mounting feet are detachably connected to the upper connecting member and the upper fixed frame, the lower deformable part comprises a second mounting portion disposed on one end of the lower deformable part and a second mounting foot disposed on at an end of the lower deformable part away from the second mounting portion, at least one second bending portion is extended from the second mounting portion to a direction away from the second mounting portion, a plurality of the upper deformable parts are connected by their respective first mounting portions, and the second mounting feet are detachably connected to the lower connecting member and the lower fixed frame.

Furthermore, the upper fixed frame is provided with a plurality of first upper mounting portions, and the first upper mounting portions are detachably connected to each of part of the first mounting feet of the plurality of upper deformable parts, the upper connecting member is provided with a plurality of second upper mounting portions, and the second upper mounting portions are detachably connected to each of the remaining parts of the first mounting feet of the plurality of upper deformable parts, the lower fixed frame is provided with a plurality of first lower mounting portions, and the first lower mounting portions are detachably connected to each of parts of the second mounting feet of the plurality of lower deformable parts, the lower connecting member is provided with a plurality of second lower mounting portions, and the second lower mounting portions are detachably connected to each of the remaining parts of the second mounting feet of the plurality of lower deformable parts.

Furthermore, the plurality of first lower mounting portions are closer to an interior of the holder for cap washing than the plurality of first upper mounting portions, the plurality of second lower mounting portions are closer to the interior of the holder for cap washing than the plurality of second upper mounting portions.

Furthermore, the upper fixed frame includes a first upper connecting portion and a second upper connecting portion provided at two ends away from each other, the upper connecting member comprises an upper connection member body, and third and fourth upper connecting portions provided at opposite ends of the upper connecting member body, the first upper connecting portion is detachably connected with the third upper connecting portion, the second upper connecting portion is detachably connected with the fourth upper connecting portion, the lower fixed frame includes a first lower connecting portion and a second lower connecting portion provided at two ends away from each other, the lower connecting member comprises a lower connection member body, and third and fourth lower connecting portions provided at opposite ends of the lower connecting member body, the first lower connecting portion is detachably connected with the third lower connecting portion, the second lower connecting portion is detachably connected with the fourth lower connecting portion.

Furthermore, the upper connecting member body and/or the lower connecting member body are formed by detachably connecting multi-stages.

Furthermore, an included angle between the two first bending portions furthest apart in at least two of the first bending portions is less than 180 degrees, an included angle between the two second bending portions furthest apart in at least two of the second bending portions is less than 180 degrees.

A holder for cap washing according to another aspect of the present disclosure, comprising: a brim supporting portion comprising a first space for accommodating a brim of the cap, and a crown supporting portion comprising a second space for accommodating a crown of the cap, wherein the brim supporting portion is detachably connected to the crown supporting portion, so that the first space for accommodating the brim is in communication with the second space for accommodating the crown.

According to one aspect of the present disclosure, it can prevent the cap from deforming during washing, which is conducive to cleaning sufficiently and avoids the trouble of cleaning, the holder for cap washing can be packaged in a plurality of small-sized parts separated from each other in length and height, which facilitates miniaturization and convenience of storage.

DETAILED DESCRIPTION

In order to make the purpose, technical solutions, and advantages of the present disclosure more clear, the following further describes the present disclosure in detail with reference to the accompanying drawings and embodiments. It should be understood that the embodiments described herein are only intended to explain the present disclosure, but not to limit the present disclosure.

In the present embodiment, a baseball cap with a tongue-shaped cap brim and a hemispheroidal cap crown covering the head is used as an example of the cap.

The present disclosure provides a holder for cap washing 100, the holder for cap washing 100 comprises an upper frame 2 and a lower frame 4 detachably connected to the upper frame 2. When use the holder for cap washing 100, by disassembling and assembling the upper frame 2 and the lower frame 4, the cap can be clamped in the gap formed between the upper frame 2 and the lower frame 4, thereby maintaining the shape of the cap, and even if the cap is put into a washing machine for cleaning, it will not deform..

Hereinafter, a configuration of the holder for cap washing 100 will be described in detail with reference to FIGS. 1 to 3.

Figure 1:
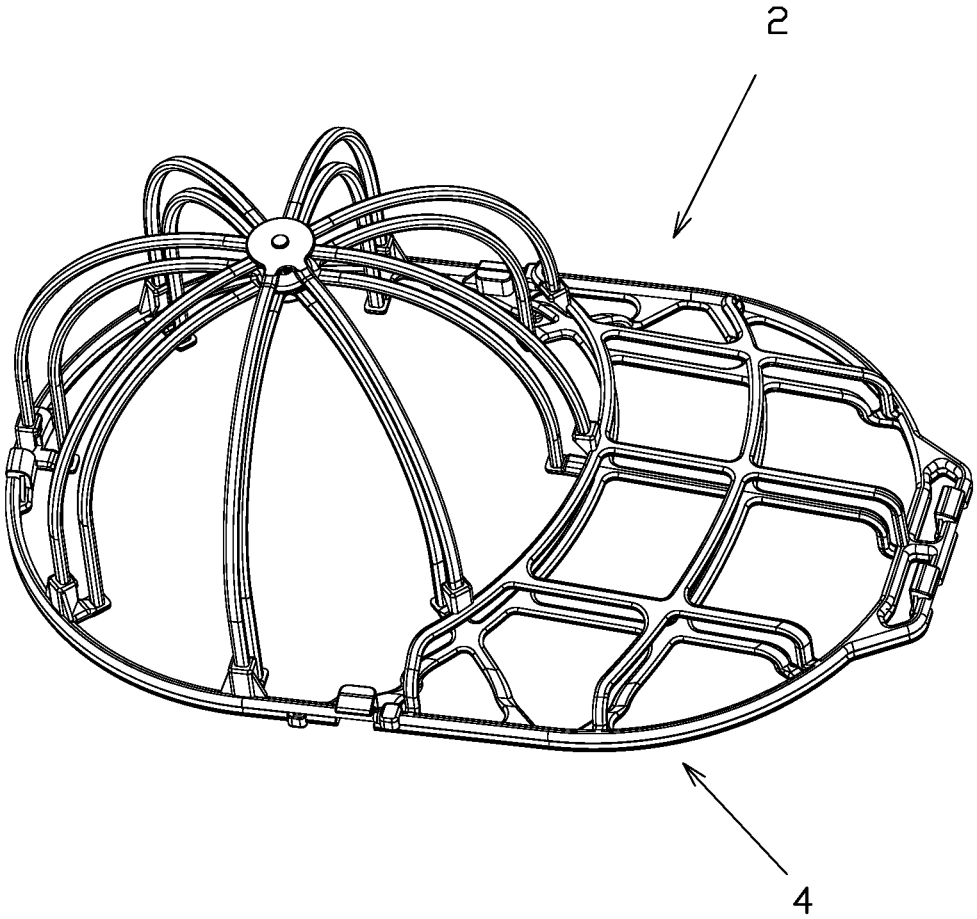
FIG. 1 is a perspective view showing an assembled state of a holder for cap washing.
Figure 2:
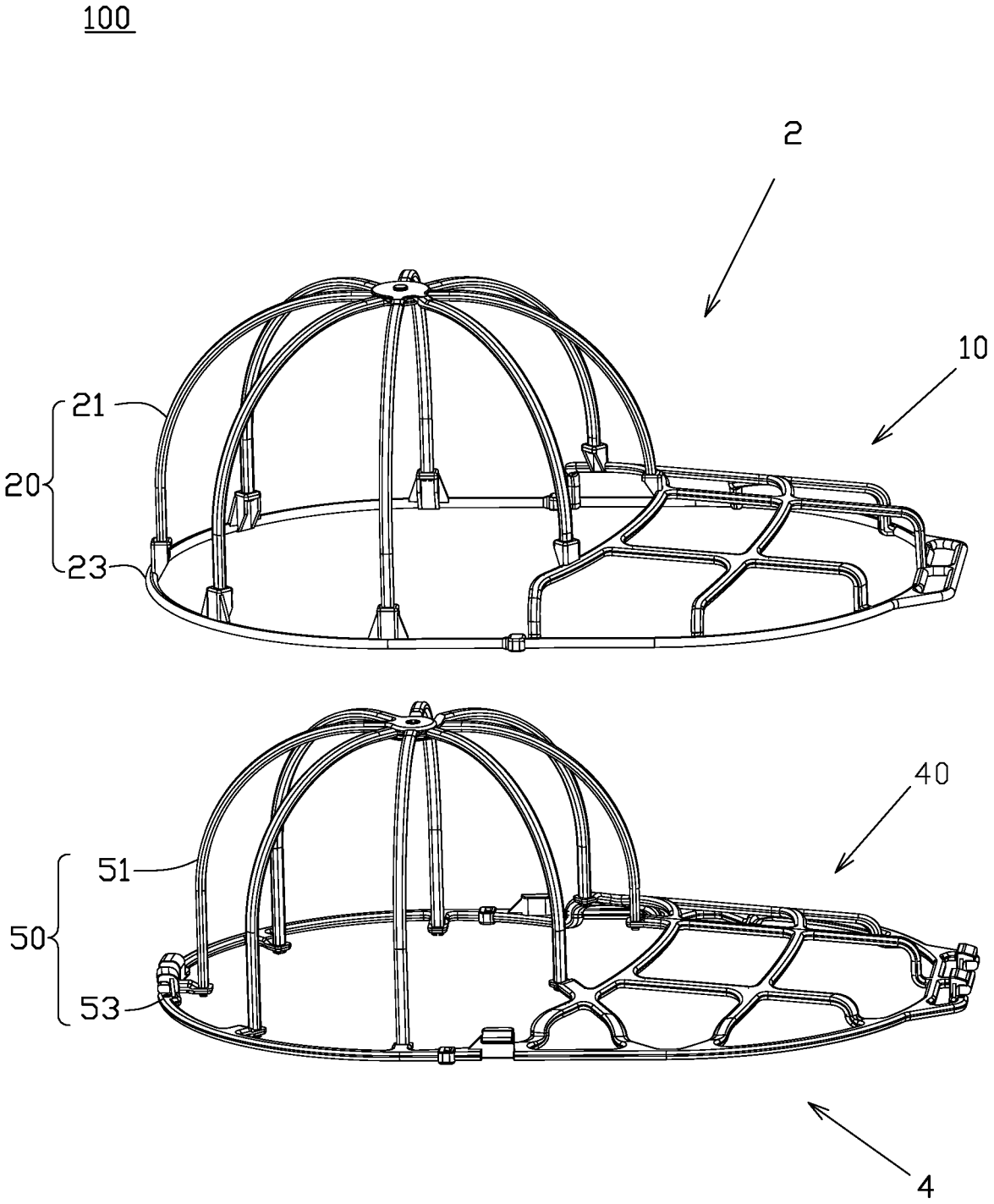
FIG. 2 is a schematic view showing an upper frame body and a lower frame body constituting the holder for cap washing.

As shown in FIGS. 1 and 2, the upper frame 2 includes an upper fixed frame 10 and an upper deformable frame 20. The lower frame 4 includes a lower fixed frame 40 and a lower deformable frame 50. The upper and lower fixed frames 10 and 40 sandwich a region corresponding to a brim of the cap (not shown) in an upper direction and a lower direction respectively, and thus the upper and lower fixed frames 10 and 40 may be collectively referred to as a brim supporting portion. Since the upper and the lower deformable frame 20 and 50 vertically sandwich a region corresponding to the crown of the cap, the upper and the lower deformable frame 20 and 50 may be collectively referred to as a crown supporting portion. Furthermore, a detachably connected structure (for example, an upper buckle 15, a first lower buckle 45, and a second lower buckle 535, which are described below) is formed in each of the upper frame 2 and the lower frame 4, so as to facilitate placing and taking of the cap.

Next, the specific configuration of the upper frame 2 will be described in detail.

In this embodiment, the upper fixed frame 10 of the upper frame 2 is formed in a tongue-shape, but is not limited thereto. The upper fixed frame 10 can be appropriately changed according to the shape of a specific portion of the cap to be prevented from being deformed, for example, the upper fixed frame 10 can be set into a ring structure according to the brim of a bucket hat.

Figure 3:
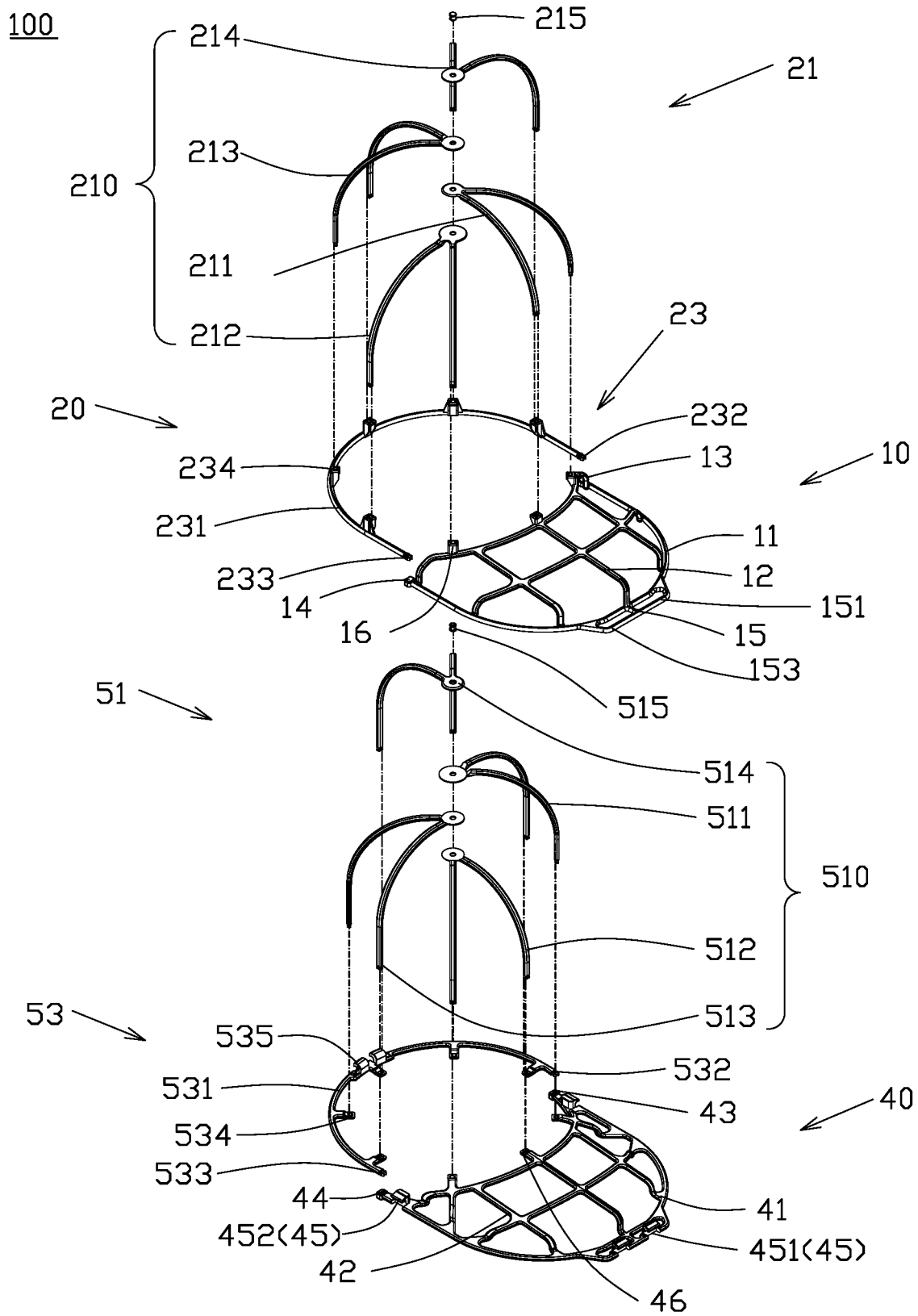
FIG. 3 is an exploded view showing the holder for cap washing.

As shown in FIG. 3, in this embodiment, the upper fixed frame 10 comprises an outer edge upper frame 11 and an upper reinforcing frame 12.

The outer edge upper frame 11 is configured to contact the brim of the cap, and is substantially a U-shape bar. The upper reinforcing frame 12 is disposed in the outer edge upper frame 11 to form a main body of the upper fixed frame 10. The outer edge upper frame 11 and the upper reinforcing frame 12 can be integrally formed, and can also be formed separately and connected by means of snap-fitting, clamp-fitting or the like.

The upper reinforcing frame 12 comprises one or more frame bars respectively connected to the outer edge upper frame 11. Furthermore, as shown in FIGS. 2 and 3, the upper reinforcing frame 12 is formed to rise from the joint with the upper edge frame 11, such that the upper reinforcing frame 12 is protrusively laid on the outer edge upper frame 11, thereby forming an accommodation space between the upper reinforcing frame 12 of the upper fixed frame 10 and the lower fixed frame 40 for accommodating the brim. In addition, when the upper reinforcing frame 12 comprises a plurality of frame bars, the plurality of frame bars may be integrally formed or may be formed independently. In addition, the one or more frame bars included in the upper reinforcing frame 12 may be integrally formed with the outer edge upper frame 11 or may be formed independently. As long as the upper fixed frame 10 can be made to have a certain structural rigidity, the number, distribution and connection structure of the frame bars of the upper reinforcing frame 12 can be changed according to practical requirements.

In addition, two ends of the outer edge upper frame 11 are provided with a first upper connecting part 13 and a second upper connecting part 14 for connecting to the upper deformable frame body 20.

In addition, an upper buckle 15 is disposed on one side of the outer edge upper frame 11 away from the two ends. As shown in FIG. 3, the upper buckle 15 comprises a clamp portion 153 formed by extending from a side away from the upper reinforcing frame 12, and further comprises a through hole 151 formed between the clamp portion 153 and the outer edge upper frame 11.

The upper reinforcing frame 12 is provided with a plurality of first upper mounting portions 16 protruding from a side thereof away from the upper buckle 15, and the plurality of first upper mounting portions 16 are used for connecting to the upper deformable frame body 20.

Next, the upper deformable frame 20 of the upper frame 2 will be described with continued reference to FIG. 3. The upper deformable frame 20 of the upper frame 2 comprises an upper deformable member 21 and an upper connecting member 23 detachably connected to the upper deformable member 21. The upper deformable member 21 is detachably mounted to the upper connecting member 23 and the first upper mounting portion 16 of the upper fixed frame 10, and the upper connecting member 23 is detachably connected to the first upper connecting portion 13 and the second upper connecting portion 14 of the upper fixed frame 10.

Specifically, the upper deformable member 21 includes a plurality of upper deformable parts 210 (four upper deformable parts 211-214 shown in the figure) and a first connecting part 215 that detachably connects the upper deformable parts 210 together. The upper deformable part 210 is made of a material with certain elasticity and certain rigidity, such as a resin material or a resin material wrapping a metal wire, which can be appropriately selected from existing materials. The upper deformable part 210 is capable of being bent and deformed, thereby conforming to the shape of an abrupt change portion of the cap, such as the crown of the cap, and securing the hat from above.

Figure 4:
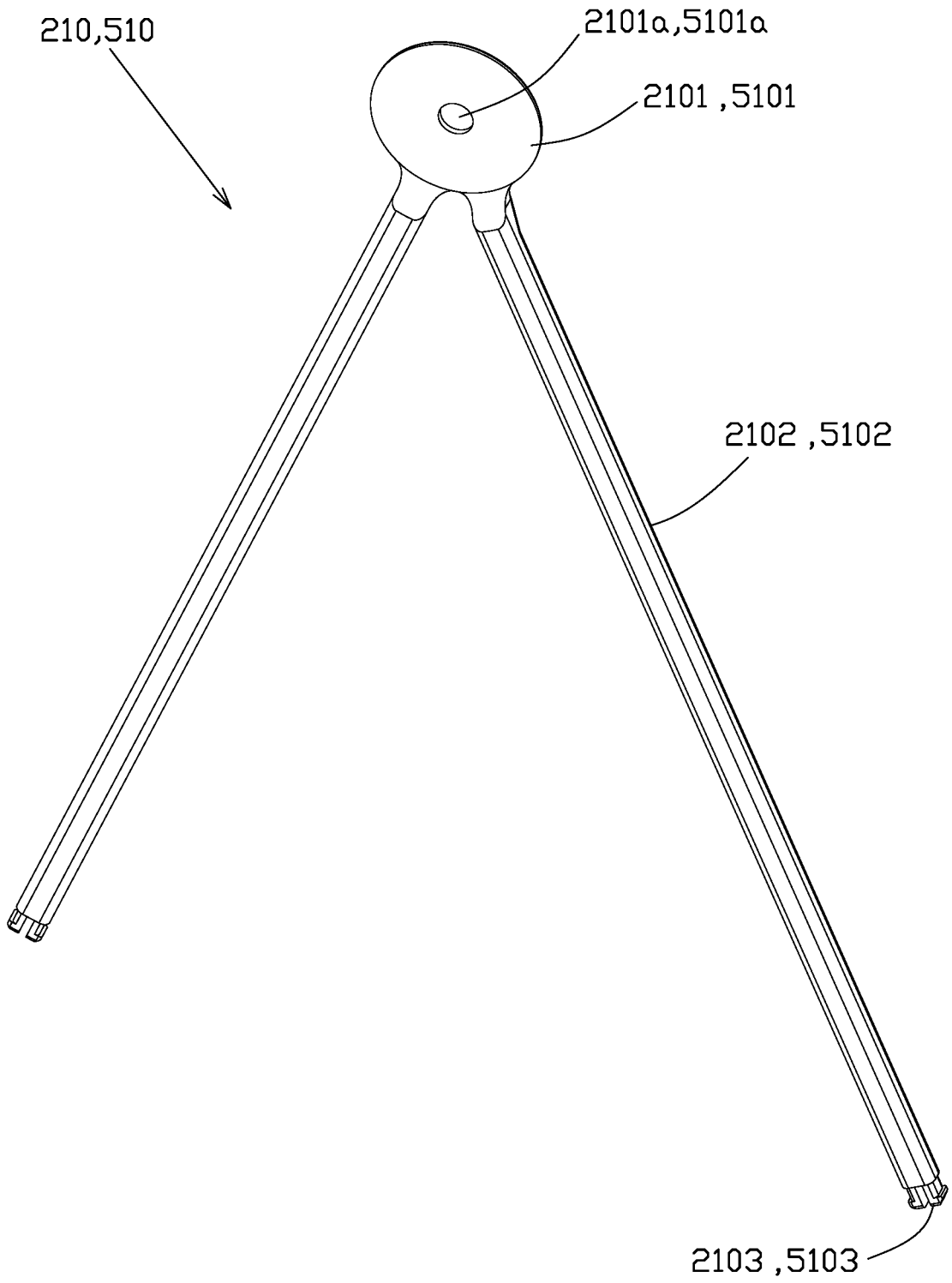
FIG. 4 is a perspective view showing an upper deformable member and a lower deformable member.

An example of the structure of the upper deformable part 210, as shown in FIG. 4., the upper deformable part 210 is formed in an inverted V-shape in a natural state. A first mounting hole 2101*a* is formed in the first mounting portion 2101 above for the first connecting part 215 to pass through, thereby connecting the plurality of upper deformable parts 210 together. Although the first connecting member 215 is pin-shaped, the present embodiment is not limited thereto, the first connecting member 215 may be of any configuration as long as the first connecting member 215 does not come out after being connected to the upper deformable parts 210. In the upper deformable part 210 comprises two first bending portions 2102 and a first mounting foot 2103, the two first bending portions 2102 are formed by extending from the first mounting portion 2101, and the first mounting foot 2103 is formed at an end of the first bending portion 2102 away from the first mounting portion 2101. In addition, the lengths of the two first bending portions 2102 of each upper deformable part 210 are not always the same, and the lengths of the first bending portions 2102 of different upper deformable parts 210 are not always the same, which can be set appropriately according to the shape of the cap. In addition, the upper deformable part 210 may be provided with only one first bending portion 2102, or may be provided with a plurality of first bending portions 2102. In addition, an angle between the adjacent first bending portions 2102 is not particularly limited, however, in order to facilitate accommodation, it is preferable that the angle between the two first bending portions 2102 furthest apart is less than 180 degrees, and more preferably, does not exceed 90 degrees. Further, the upper deformable member 21 may be integrally formed.

The upper connecting member body 231 of the upper connecting member 23 is substantially in a U-shaped shape, and a third upper connecting portion 232 and a fourth upper connecting portion 233 configured for respectively connecting to the first upper connecting portion 13 and the second upper connecting portion 14 of the described outer edge upper frame 11 are provided at both ends of the upper connecting member body 231. The third upper connecting portion 232 is detachably connected to the first upper connecting portion 13 of the upper frame 10, and the fourth upper connecting portion 233 is detachably connected to the second upper connecting portion 14 of the upper frame 10.

A plurality of second upper mounting portions 234 protrude along the upper connecting member body 231, and are detachably connected with the upper deformable part 210.

Specifically, during assembly, as shown in FIG. 3, the upper deformable member 21 is formed by assembling the first connecting member 215 through the first mounting hole 2101 a of each of the four upper deformable members 211-214; Next, the first upper connecting portion 13 and the second upper connecting portion 14 are connected to the third upper connecting portion 232 and the fourth upper connecting portion 233 by placing the U-shaped opening of the outer edge upper frame 11 of the upper frame 10 facing the U-shaped opening of the upper connecting member body 231, and thus the upper fixed frame 10 and the upper connecting member 23 are assembled; Then, the upper deformable frame 20 is assembled by mounting one first mounting foot 2103 of the upper deformable members 212 and two first mounting feet 2103 of the respective upper deformable members 213 and 214 of the four upper deformable members 211-214 in a curved manner to five second upper mounting portions 234 provided on the upper connecting member body 231; Then, the remaining first mounting feet of the four upper deformable members 211-214, i. e., the two first mounting feet 2103 of the upper deformable member 211 and the other first mounting foot 2103 of the upper deformable member 212, are successively mounted in a curved manner to the three first upper mounting portions 16 provided on the upper fixed frame 10, thereby the upper frame 2 are assembled. Furthermore, the connection order described above is just an example, and can be adjusted as appropriate.

In the present disclosure, the number of the first upper mounting portion 16 and the second upper mounting portion 234, the number of the respective corresponding upper deformable parts 210, and the arrangement relationship of the first mounting feet 2103 can be changed according to practical requirements. At least one of the upper deformable parts 210 may be connected across the upper fixed frame body 10 and the upper connecting member 23, in other words, different first mounting feet 2103 provided by the same upper deformable part 210 are connected to the upper fixed frame body 10 and the upper connecting member 23 respectively, so that better connection stability can be achieved, and it is ensured that the components of the holder for cap washing 100 will not be loosened during washing. However, the present disclosure is not limited thereto, and all of the first mounting feet 2103 of the same upper deformable part 210 may be provided only in the first upper mounting portion 16 of the upper fixed frame 10 or in the second upper mounting portion 234 of the upper connecting member 23.

Next, the specific configuration of the lower frame 4 will be described in detail.

As shown in FIGS. 1 to 3, the lower fixed frame 40 of the lower frame 4 is formed into a tongue shape similarly to the upper fixing frame 10, but is not limited thereto, and the lower fixed frame 40 may be formed to cooperate with the upper fixed frame 10 in shape.

As shown in FIG. 3, the lower fixed frame body 40 of the present embodiment is formed in a tongue-shape corresponding to the upper fixed frame body 10 of the upper frame 2. The lower fixed frame 40 comprises an outer edge lower frame 41 and a lower reinforcing frame 42.

The outer edge lower edge frame 41 is configured to contact a brim of the cap, and is substantially in a U-shape. The lower reinforcing frame 42 is disposed in the outer edge lower frame 41 to form a main body of the lower fixed frame 40. The outer edge lower frame 41 and the lower reinforcing frame 42 can be integrally formed, and can also be formed separately and connected by means of snap-fitting, clamp-fitting or the like.

The lower reinforcing frame 42 comprises one or more frame bars, and the frame bars are connected to the outer edge lower frame 41. As long as the laying height of the lower reinforcement frame 42 is lower than that of the upper reinforcement frame 12, a space for accommodating the brim of the cap can be formed between the upper fixed frame 10 and the lower fixed frame 40. For example, as shown in FIGS. 2 and 3, the lower reinforcing frame 42 may be formed to rise from the joint with the lower edge frame 41, such that the lower reinforcing frame 42 is protrusively laid on the outer edge lower frame 41, or may also be formed flush with the outer edge lower frame 41, or may be formed to be recessed from the joint with the outer edge lower frame 41, and the height of the lower reinforcing frame 42 may be appropriately determined according to the curved shape, thickness, and height of the brim of the cap. In addition, in the case that the lower reinforcing frame 42 comprises a plurality of frame bars, the plurality of frame bars may be integrally formed or may be formed independently. In addition, the one or more frame bars included in the lower reinforcing frame 42 may be integrally formed with the outer edge lower frame 41 or may be formed independently. It can be understood that, as long as the lower fixed frame body 40 has a certain structural rigidity, the number, distribution and connection relationship of the frame bars of the lower reinforcing frame body 42 can be changed according to practical requirements.

In addition, two ends of the outer edge lower frame 41 are provided with a first lower connecting part 43 and a second lower connecting part 44 for connecting to the lower deformable frame body 50.

In addition, at least one first lower buckle 45 detachably connected to the upper fixed frame 10 is disposed on the outer edge lower frame 41. The at least one first lower buckle 45 comprises a front lower buckle 451 configured for detachably connecting to an upper buckle 15 of the upper fixed frame body 10, in which the front lower buckle 451 extends out of one side of the outer edge lower frame 41 away from the lower reinforcing frame body 42, and the front lower buckle 451 is detachably connected to the upper buckle 15. The at least one first lower buckle 45 further comprises a side lower buckle 452 configured for being detachably connected to the outer edge upper frame 11 of the upper fixed frame 10, wherein the side lower buckle 452 is disposed between the upper buckle 15 and the end of the outer edge lower frame 41, and the outer edge upper frame 11 and the side lower buckle 452 (the first lower buckle 45) are detachably connected to each other. In addition, a side upper buckle (not shown) detachably connected to the outer edge lower frame 41 may be disposed along the side edge direction of the outer edge upper frame 11 instead of the side lower buckle 452. In addition, the side lower buckle 452 may be omitted.

A plurality of first lower mounting portions 46 protrude from a side of the lower fixed frame body 40 away from the front lower buckle 451, and the plurality of first lower mounting portions 46 are configured for connecting to the lower deformable frame body 50. The first lower mounting portion 46 extends from the lower reinforcing frame 42 toward the interior of the holder for cap washing 100, that is, extends to the side away from the outer edge lower frame 41. Since the plurality of first lower mounting portions 46 extends from the lower reinforcing frame 42 to the side away from the outer edge lower frame 41, and the plurality of first upper mounting portions 16 protrude from the upper reinforcing frame 12, in a combined state of the upper frame 2 and the lower frame 4, the plurality of first lower mounting portions 46 are closer to the interior of the holder for cap washing 100 than the plurality of first upper mounting portions 16.

Next, the lower deformable frame 50 of the lower frame 4 will be described with continued reference to FIG. 3. The lower deformable frame 50 of the lower frame 4 comprises a lower deformable member 51 and a lower connecting member 53 detachably connected to each other. The lower deformable member 51 is detachably attached to the lower connecting member 53 and the first lower mounting portion 46 of the lower fixed frame 40. The lower connecting member 53 is detachably connected to the first lower connecting portion 43 and the second lower connecting portion 44 of the lower fixed frame 40.

In particular, the lower deformable member 51 includes a plurality of lower deformable parts 510 (four lower deformable parts 511-514 shown in the figures) and a second connecting part 515 that detachably connects each lower deformable part 510 together. The lower deformable part 510 is made of a material with certain elasticity and certain rigidity, such as a resin material or a resin material wrapping a metal wire, which can be appropriately selected from existing materials. The lower deformable part 510 can be bent and deformed, thereby conforming to the shape of the abrupt change portion of the cap, such as the shape of the crown of the cap, and supports and fixes the cap from below.

An example of the structure of the lower deformable part 510 has a configuration similar to that of the upper deformable part 210 as shown in FIG. 4, and is formed in an inverted "V" shape in a natural state, and a second mounting hole 5101*a* is formed in the upper second mounting portion 5101 for the second connecting part 515 to pass through, thereby connecting the plurality of lower deformable parts 510 together. Although the second connecting member 515 is pin-shaped, the present embodiment is not limited thereto, the first connecting member 515 may be of any configuration as long as the second connecting member 515 does not come out after being connected to the lower deformable parts 510. In the lower deformable part 510, two second bending portions 5102 are formed by extending from the second mounting portion 5101, and a second mounting foot 5103 is formed at an end of the second bending portion 5102 away from the second mounting portion 5101. The lengths of the two second bending portions 5102 of each lower deformable part 510 are not always the same, and the lengths of the second bending portions 5102 of different lower deformable parts 510 are not always the same, which can be set appropriately according to the shape of the cap. In addition, the lower deformable part 510 may be provided with only one second bending portion 5102, or may be provided with a plurality of second bending portions 5102. In addition, an angle between the adjacent second bending portions 5102 is not particularly limited, however, in order to facilitate accommodation, it is preferable that the included angle between the two second bending portions 5102 furthest apart is less than 180 degrees, and more preferably, does not exceed 90 degrees. In addition, it is understood that the lower deformable member 51 may be integrally formed. In addition, the number of lower deformable parts 510, the number of forming curved portions, the length, the included angle, and the like may be different from the upper deformable parts 210.

The lower connecting member body 531 of the lower connecting member 5 is substantially in a U-shaped shape, and a third lower connecting portion 532 and a fourth lower connecting portion 533 for respectively connecting to the first lower connecting portion 43 and the second lower connecting portion 44 of the described outer edge lower frame 41 are provided at both ends of the lower connecting member body 531. The third lower connecting part 532 is detachably connected to the first lower connecting part 43 provided on the lower fixed frame 40, and the fourth lower connecting part 533 is detachably connected to the second lower connecting part 44 provided on the lower fixed frame 40.

A plurality of second lower mounting portions 534 are provided along the lower connecting member body 531, the plurality of second lower mounting portions 534 extend from the lower connecting member body 531 towards the interior of the holder for cap washing 100, i. e. the curved interior of the lower connecting member body 531, and the plurality of second lower mounting portions 534 are configured for being detachably connected to the lower deformable member 510. Since the plurality of second lower mounting portions 534 extend toward the bent interior of the connecting member body 531, and the second upper mounting portion 234 is protruded from the upper connecting member body 231, in a state that the upper frame 2 and the lower frame 4 are combined, the second lower mounting portion 534 is closer to the interior of the holder for cap washing 100 than the second upper mounting portion 234, so that, after the upper frame 2 and the lower frame 4 are assembled, the lower deformable member 51 is covered with the upper deformable member 21, an accommodation space for accommodating the cap crown can be formed between the lower deformable member 51 and the upper deformable member 21.

The lower connecting member body 531 is provided with at least one second lower buckle for connecting with the upper connecting member body 231 of the upper connecting member 23. The at least one second lower buckle includes a second lower buckle 535 detachably connected to the upper connecting member body 231. In addition, the at least one second lower buckle may also include a second lower buckle disposed on a side edge between the second lower buckle 535 and the end of the lower connecting member body 531. In addition, in place of at least one second lower buckle, a second upper buckle (not shown) detachably connected to the lower connecting member body 531 may be provided on the upper connecting member body 231.

Specifically, during assembly, as shown in the example of FIG. 3, the lower deformable member 51 is formed by assembling the second connecting member 515 through the second mounting hole 5101*a* of each of the four lower deformable members 511-514; Next, the first lower connecting portion 43 and the second lower connecting portion 44 are connected to the third lower connecting portion 532 and the fourth lower connecting portion 533, and the lower fixed frame 40 and the lower connecting member 53 are assembled; Then, the lower deformable frame 50 is assembled by mounting one second mounting foot 5103 of the lower deformable members 511 and two second mounting feet 5103 of the respective lower deformable members 513 and 514 of the four lower deformable members 511-514 in a curved manner to five second lower mounting portions 534 provided on the lower connection member body 531; Then, the remaining second mounting feet of the four lower deformable members 511-514, i. e., another second mounting feet 5103 of the lower deformable member 511 and the two second mounting feet 5103 of the lower deformable member 512, are successively mounted in a curved manner to the three first lower mounting portions 46 provided on the lower fixed frame 40, thereby the lower frame 4 are assembled. The connection order described above is just an example, and can be adjusted as appropriate.

It can be understood that, in the present disclosure, the number of the first lower mounting portion 46 and the second lower mounting portion 534, the number of the respective corresponding lower deformable parts 510, and the arrangement relationship of the second mounting feet 5103 can be changed according to practical requirements. At least one of the lower deformable parts 510 may be connected across the lower fixed frame body 40 and the lower connecting member 53, in other words, different second mounting feet 5103 provided by the same lower deformable part 510 are connected to the lower fixed frame body 40 and the lower connecting member 53 respectively, so that better connection stability can be achieved, and it is ensured that the components of the holder for cap washing 100 will not be loosened during washing. However, the present invention is not limited thereto, and all of the second mounting portions 5103 of the same lower deformable member 510 may be provided only in the first lower mounting portion 46 of the lower fixed frame body 40 or in the second lower mounting portion 534 of the lower connecting member 53.

The upper frame 2 and the lower frame 4 are assembled as described above, and then the front lower fastening member 451 of the lower frame 4 is fastened to the upper fastening member 15 of the upper frame 2, so that the front lower fastening member 451, which is, for example, a hook shape, passes through the through hole 151 to be hooked on the clamping portion 153, and the side lower fastening member 452 of the lower frame 4 faces the outer edge of the upper frame 2, so that the side lower fastening members 452, which are, for example, hook-shaped members, are hooked on the outer rim upper frame 11 from below and inside of the outer rim upper frame 11, After the upper frame 2 and the lower frame 4 are assembled, the plurality of first lower mounting portions 46 are closer to the interior of the holder for cap washing 100 than the plurality of first upper mounting portions 16, the plurality of second lower mounting portions 534 are closer to the interior of the holder for cap washing 100 than the plurality of second upper mounting portions 234, thus, the lower deformable member 51 connected to the first lower mounting portion 46 and plurality of second lower mounting portions 534 is closer to the interior of the holder for cap washing 100 compared to the upper deformable member 21 connected to plurality of first upper mounting portions 16 and plurality of second upper mounting portions 234, thereby an accommodation space for accommodating the cap crown can be formed between the lower deformable member 51 and the upper deformable member 21. Furthermore, the upper reinforcing frame 12 is disposed at a higher level than the lower reinforcing frame 42, so that an accommodation space for accommodating the brim is formed between the upper reinforcing frame 12 and the lower reinforcing frame 42, In addition, the plurality of first upper mounting portions 16 provided on the upper reinforcing frame 12 are also higher in height than the first lower mounting portions 46 provided on the lower reinforcing frame 42, so that the accommodation space for accommodating the cap crown and the accommodation space for accommodating the cap rim are communicated with each other, and thus the cap can be accommodated between the upper frame 2 and the lower frame 4.

In addition, hanging the upper frame 2 at least by using two opposite sides of the front lower buckle 451 and the second lower buckle 535 towards the long side direction of the holder for cap washing 100, so that better connection stability can be achieved, and it is ensured that the components of the holder for cap washing 100 will not be loosened during washing. In addition, by arranging two opposite sides facing the short side direction of the holder for cap washing 100 to hook the side lower buckle 452 of the upper frame 2, the connection stability of the holder for cap washing 100 can be further improved.

In use, a user can assemble the components to form the upper frame 2 and the lower frame 4, place the cap on the upper surface of the lower frame 4, and then cover the lower frame 4 with the upper frame 2 in such a manner that the front lower buckle 451 of the lower frame 4 faces the upper buckle 15 of the upper frame 2. Then, according to the foregoing steps of assembling the upper frame 2 and the lower frame 4, the cap is built into the holder for cap washing 100. Thus, the user can put the holder for cap washing 100 with a cap built therein into the washing machine for washing, and its operation is convenient.

In addition, the whole of the holder for cap washing 100 may also be formed by using a material having a certain elasticity and a certain rigidity. It can be understood that it can be appropriately selected according to actual needs.

Thus, by the holder for cap washing 100 according to the above embodiment, it can prevent the cap from deforming during washing, which is conducive to cleaning sufficiently and avoids the trouble of cleaning. At the same time, due to the special shape of the holder for cap washing 100, especially the upper deformable frame body 20 and the lower deformable frame body 50 can be packaged in a plurality of small-sized parts separated from each other in length and height, which facilitates miniaturization and convenience of storage.

In addition, the upper connecting member body 231 and the lower connecting member body 531 may be made of a material having a certain elasticity and a certain rigidity, so that the upper connecting member body 231 and the lower connecting member body 531 can be further bent into a desired shape during transportation or storage, further may be made of a material which is continuous as a whole, or may be formed by connecting a plurality of segments in cooperation. When the upper connecting member body 231 and the lower connecting member body 531 are formed by the multi-stage fitting connection, the packing size of the holder for cap washing 100 is further miniaturized.

The foregoing description is merely a preferred detailed implementation of the present disclosure, but the scope of protection of the present disclosure is not limited thereto. Any people skilled in the art would be able to make equivalent replacements or changes within the technical scope disclosed by the present disclosure according to the technical solutions of the present disclosure and the inventive concept thereof, and all should be covered within the scope of protection of the present disclosure.

What is claimed is:

1. A holder for cap washing, comprising:

an upper frame comprising an upper fixed frame and an upper deformable frame detachably connected to the upper fixed frame; and a lower frame detachably connected to the upper frame and comprising a lower fixed frame and a lower deformable frame detachably connected to the lower fixed frame, wherein the upper fixed frame is detachably mounted to the lower fixed frame, and a first space for accommodating a brim of the cap is formed between the upper fixed frame and the lower fixed frame, the upper deformable frame is detachably mounted to the lower deformable frame, and a second space for accommodating a crown of the cap is formed between the upper deformable frame and the lower deformable frame.

2. The holder for cap washing according to claim 1, wherein the upper deformable frame comprises:

an upper deformable member having elasticity, and capable of being bent and deformed according to the shape of the crown, and detachably connected to the upper fixed frame, an upper connecting member detachably connected to the upper deformable member, the lower deformable frame comprises:

a lower deformable member having elasticity, and capable of being bent and deformed according to the shape of the crown, and detachably connected to the lower fixed frame, and a lower connecting member detachably connected to the lower deformable member.

3. The holder for cap washing according to claim 2, wherein the upper deformable member comprises a plurality of upper deformable parts, one end of each of the plurality of upper deformable parts is connected to each other, and the other end of each of the plurality of upper deformable parts is detachably connected to the upper connecting member and the upper fixed frame, and the lower deformable member comprises a plurality of lower deformable parts, one end of each of the plurality of lower deformable parts is connected to each other, and the other end of each of the plurality of lower deformable parts is detachably connected to the lower connecting member and the lower fixed frame.

4. The holder for cap washing according to claim 3, wherein the upper deformable part comprises a first mounting portion disposed on one end of the upper deformable part and a first mounting foot disposed on at an end of the upper deformable part away from the first mounting portion, at least one first bending portion is extended from the first mounting portion to a direction away from the first mounting portion, a plurality of the upper deformable parts are connected by their respective first mounting portions, and the first mounting feet are detachably connected to the upper connecting member and the upper fixed frame, the lower deformable part comprises a second mounting portion disposed on one end of the lower deformable part and a second mounting foot disposed on at an end of the lower deformable part away from the second mounting portion, at least one second bending portion is extended from the second mounting portion to a direction away from the second mounting portion, a plurality of the upper deformable parts are connected by their respective first mounting portions, and the second mounting feet are detachably connected to the lower connecting member and the lower fixed frame.

5. The holder for cap washing according to claim 4, wherein the upper fixed frame is provided with a plurality of first upper mounting portions, and the first upper mounting portions are detachably connected to each of part of the first mounting feet of the plurality of upper deformable parts, the upper connecting member is provided with a plurality of second upper mounting portions, and the second upper mounting portions are detachably connected to each of the remaining parts of the first mounting feet of the plurality of upper deformable parts, the lower fixed frame is provided with a plurality of first lower mounting portions, and the first lower mounting portions are detachably connected to each of parts of the second mounting feet of the plurality of lower deformable parts, the lower connecting member is provided with a plurality of second lower mounting portions, and the second lower mounting portions are detachably connected to each of the remaining parts of the second mounting feet of the plurality of lower deformable parts.

6. The holder for cap washing according to claim 5, wherein the plurality of first lower mounting portions are closer to an interior of the holder for cap washing than the plurality of first upper mounting portions, the plurality of second lower mounting portions are closer to the interior of the holder for cap washing than the plurality of second upper mounting portions.

7. The holder for cap washing according to claim 4, wherein an included angle between the two first bending portions furthest apart in at least two of the first bending portions is less than 180 degrees, an included angle between the two second bending portions furthest apart in at least two of the second bending portions is less than 180 degrees.

8. The holder for cap washing according to claim 2, wherein the upper fixed frame includes a first upper connecting portion and a second upper connecting portion provided at two ends away from each other, the upper connecting member comprises an upper connection member body, and third and fourth upper connecting portions provided at opposite ends of the upper connecting member body, the first upper connecting portion is detachably connected with the third upper connecting portion, the second upper connecting portion is detachably connected with the fourth upper connecting portion, the lower fixed frame includes a first lower connecting portion and a second lower connecting portion provided at two ends away from each other, the lower connecting member comprises a lower connection member body, and third and fourth lower connecting portions provided at opposite ends of the lower connecting member body, the first lower connecting portion is detachably connected with the third lower connecting portion, the second lower connecting portion is detachably connected with the fourth lower connecting portion.

9. The holder for cap washing according to claim 8, wherein the upper connecting member body and/or the lower connecting member body are formed by detachably connecting multi-stages.

10. A holder for cap washing, comprising:

a brim supporting portion comprising a first space for accommodating a brim of the cap, and a crown supporting portion comprising a second space for accommodating a crown of the cap, wherein the brim supporting portion is detachably connected to the crown supporting portion, so that the first space for accommodating the brim is in communication with the second space for accommodating the crown.

* * * * *